United States Patent [19]

Emonet

[11] Patent Number: 4,576,241

[45] Date of Patent: Mar. 18, 1986

[54] TOOL ASSEMBLY AND HANDLE ASSEMBLY THEREFOR

[76] Inventor: Henri Emonet, 12 Rue R.P. Couturier, Montbrison (Loire), France

[21] Appl. No.: 553,409

[22] Filed: Nov. 21, 1983

[30] Foreign Application Priority Data

Feb. 3, 1983 [EP] European Pat. Off. ..... 83420020.6

[51] Int. Cl.[4] ..... B25D 17/04

[52] U.S. Cl. ..... 173/162 H; 173/170

[58] Field of Search ..... 173/162, 162 H, 170; 16/110 R; 74/543

[56] References Cited

U.S. PATENT DOCUMENTS 1,644,030 10/1927 Prellwitz ..... 173/162 H
3,322,211 5/1967 Alabuzhev et al. ..... 173/162 H
4,060,138 11/1977 Cox et al. ..... 173/162 H
4,282,938 8/1981 Minamidate ..... 173/162 H

FOREIGN PATENT DOCUMENTS 154206 3/1982 Fed. Rep. of Germany ... 173/162 R

*Primary Examiner*—Donald R. Schran
*Assistant Examiner*—James Wolfe
*Attorney, Agent, or Firm*—Remy J. VanOphem

[57] ABSTRACT

A tool assembly of the automatic hammering or roto-hammering type and a handle assembly therefor. The tool assembly includes a breaking tool having a longitudinal axis. The handle assembly includes a head fixedly interconnected with the tool and two handles pivotally interconnected with the head. The handles include elongated crossed levers and are each provided with biasing members biasing the handles towards the head.

10 Claims, 3 Drawing Figures

Fig 1
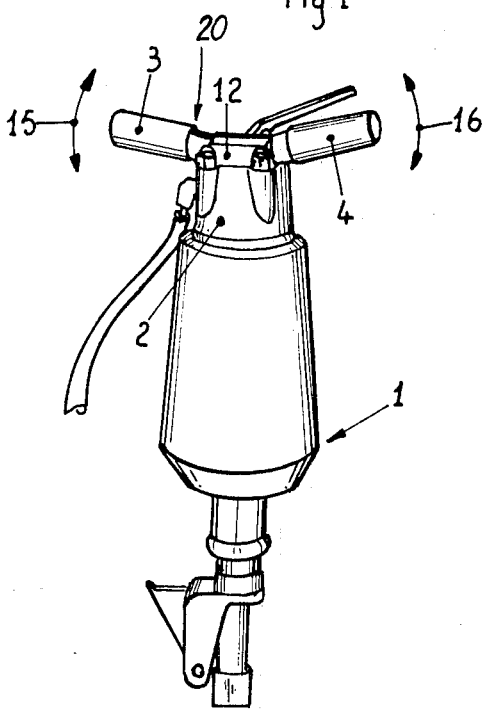
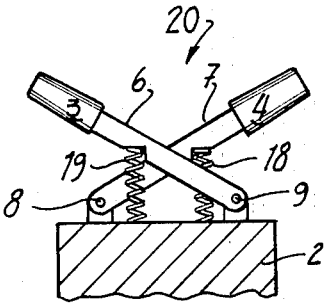
Fig 3
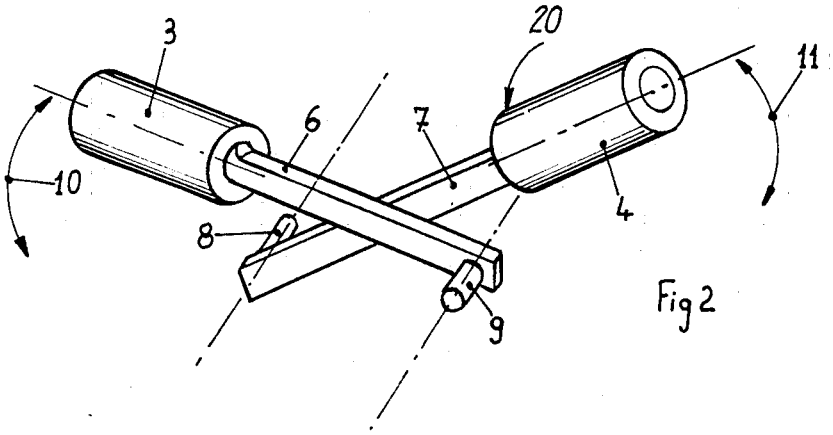
Fig 2

TOOL ASSEMBLY AND HANDLE ASSEMBLY THEREFOR

BACKGROUND OF THE PRESENT INVENTION

The present invention relates to a hammering or roto-hammering tool assembly known under the name of a jack-hammer, a concrete-breaker, or a drill hammer. It is known that such an apparatus has handles serving to hold and guide the tool. The power supply of the tool assembly can be of any convenient form.

Since such a tool assembly experiences extreme vibrations, an attempt has been made to make the tool easier to control by suspending the handles with respect to the body of the apparatus. For this purpose, one solution consists in mounting the handles on a hollow cylindrical head which constitutes a jack sliding on the body of the hammer.

The disadvantages of this known solution are many.

In particular, the effectiveness of a suspension decreases when friction occurs. There are enormous frictional forces on a large diameter during the movement of the sliding head which carries the handles. This movement likewise occurs over a great length. Consequently, it has been found that this movement gives rise to the appearance of hard points after a certain period of use at the work places.

In the case of a compressed air powered tool, the air comes into the handles, which are suspended, and is then fed to the body of the tool, which is not suspended. Sealing joints or flexible delivery tubing should, therefore, be provided between the two parts, suspended and not suspended.

If the pick or breaking tool of the tool assembly happens to become jammed, it is not possible to make the apparatus operate at an idling condition to loosen the pick, as is customary on nonsuspended apparatus.

SUMMARY OF THE PRESENT INVENTION

The primary object of the present invention is avoiding these disadvantages by making a tool with suspended handles which presents no danger of jamming while permitting an idling operation to loosen the pick. More particularly, the object of the present invention is to make a suspension system for the handles of a tool assembly which will be independent of the tool assembly so it can be retrofitted to an existing tool assembly.

A tool assembly according to the present invention includes a hammer assembly having two handles surmounting the body of the tool. Each handle is provided with an integral lever pivotally mounted to the top of the hammer body such as to pivot around an axis perpendicular to the longitudinal axis of the pick or breaking tool.

According to another feature of the present invention, the two levers are crossed, which makes it possible to impart to the handle assembly a total effective length which is double that of either handle. This lengthening of the lever arm of the handle makes it possible to impart to the handles a high damping action without making their angle of inclination relative to the top of the tool assembly very large.

According to another feature of the present invention, the handle assembly, consisting of the two handles and the head on which they are mounted, constitutes an independent unit which can be fitted to a new tool assembly hammer especially designed for this handle assembly or alternatively to an existing tool assembly as a retrofit.

BRIEF DESCRIPTION OF THE DRAWING

The attached drawing, given as a nonlimiting example, will make it possible to understand better the characteristics of the invention. In the drawing:

FIG. 1 is a perspective view of a cement breaker hammer according to the present invention;

FIG. 2 is an exploded partial view showing details of the handle assembly of the hammer of FIG. 1; and FIG. 3 is a schematic view of the handle assembly of FIG. 2.

DETAILED DESCRIPTION OF THE PREFERRED EMBODIMENT

In the drawings a tool assembly or cement breaker hammer 1, well known in the art, has been represented. The cement breaker hammer 1 is provided with a handle assembly including a head 2 interconnecting two control handles 3 and 4.

According to one of the features of the present invention, each handle 3 and 4 is integrally formed or connected with a lever 6 and 7, respectively. These levers 6 and 7 cross each other, as shown in FIG. 2. Each of the levers 6 and 7 has at its end remote from the handle 3 or 4, respectively, a transverse cylindrical pivot pin 9 and 8, respectively. The levers are pivotally interconnected with the head 2 by means of the pivot pins 8 and 9.

It is seen in FIGS. 1 and 2 that the two levers 6 and 7 are mounted side by side such that the pivot pins 8 and 9 are parallel to each other and project transversely in opposite directions. The pivot pin 8 of the lever 7 is turned toward the rear in FIG. 2 while the pivot pin 9 of the lever 6 is turned toward the front. Thus, the two levers 6 and 7 may swing in the directions indicated, respectively, by the arrows 10 and 11. The corresponding handle 3 and 4 may, therefore, pivot in the directions indicated, respectively, by the arrows 15 and 16, about the pivot pins 8 and 9.

The levers 6 and 7 of the swinging handles 3 and 4 are provided with elastic restoring means or biasing means 18 and 19, respectively, which tend to restore the handles upwardly, the levers 6 and 7 then coming to strike against the top 12 of the head 2 of the cement breaker hammer 1. These elastic restoring means may be of any appropriate kind such as, metallic springs, rubber or similar restoring members, or else pneumatic or hydraulic jacks.

It will become apparent to those skilled in the art that a device according to the present invention, as shown in the drawing and described above, has numerous advantages.

One advantage is that the handle assembly is independent of the tool assembly. Thus, the head 2 and the handles 3 and 4 may be adapted to fit existing cement breaker hammers 1.

The principle of the handles 3 and 4 being hinged on the pins 8 and 9 suppresses friction almost entirely.

The advantages of a tool assembly without any suspension are retained, in that it can run in an idling condition to make the picks come loose.

The crossed arrangement of the levers 6 and 7, each having a long length, permits obtaining the largest possible lever arm to impart a high suspension action to the handles 3 and 4, while causing their angle of direction relative to the top 12 of the head 2 to vary only slightly.

The above constitutes a detailed description of an exemplary embodiment of the present invention. Variations therefrom will be apparent to those skilled in the art and are included within the scope of the claims appended hereto.

What is claimed as novel is as follows:

1. A tool assembly comprising:

a tool having a longitudinal axis;

a head fixedly interconnected with said tool;

first handle means having a first end pivotally interconnected with said head such as to pivot about a first pivot axis perpendicular to said longitudinal axis, and a second end opposite said first end;

second handle means formed non-integrally with said first handle means and having a first end pivotally interconnected with said head such as to pivot about a second pivot axis parallel to said first pivot axis and spaced away therefrom, and a second end opposite said first end, the plane of said first pivot axis being disposed between said first end and said second end of said second handle means, and the plane of said second pivot axis being disposed between said first end and said second end of said first handle means, whereby said first handle means crosses said second handle means, said first and second pivot axes together defining a plane perpendicular to said longitudinal axis;

first biasing means interposed said first handle means and said head and biasing said second end of said first handle means away from said head in a direction such that said first handle means extends from said first end towards said second end thereof in a direction generally towards said second pivot axis; and second biasing means interposed said second handle means and said head and biasing said second end of said second handle means away from said head in a direction such that said second handle means extends from said first end towards said second end thereof in a direction generally towards said first pivot axis.

2. The tool assembly of claim 1 wherein each of said first and second handle means are pivotally interconnected with said head by means of a pin.

3. The tool assembly of claim 1 wherein at least one of said first and second handle means further comprises:

an elongated lever member pivotally interconnected with said head; and handle grip means fixedly interconnected with said elongated lever member.

4. The tool assembly of claim 1 wherein at least one of said first and second biasing means comprises a spring.

5. The tool assembly of claim 1 wherein at least one of said first and second biasing means comprises a jack.

6. A handle assembly for suspending a tool assembly having a longitudinal axis, said handle assembly comprising:

a head fixedly interconnectable with said tool assembly;

first handle means having a first end pivotally interconnected with said head such as to pivot about a first pivot axis perpendicular to said longitudinal axis, and a second end opposite said first end;

second handle means formed non-integrally with said first handle means having a first end pivotally interconnected with said head such as to pivot about a second pivot axis parallel to said pivot axis and spaced away therefrom, and a second end opposite said first end, the plane of said first pivot axis being pivotally disposed between said first end and said second end of said second handle means, the plane of said second pivot axis being disposed between said first end and said second end of said first handle means, whereby said first handle means crosses said second handle means, said first and second pivot axes together defining a plane perpendicular to said longitudinal axis;

first biasing means interposed said first handle means and said head and biasing said second end of said first handle means away from said head in a direction such that said first handle means extends from said first end towards said second end thereof in a direction generally towards said second pivot axis; and second biasing means interposed said second handle means and said head and biasing said second end of said second handle means away from said head in a direction such that said second handle means extends from said first end towards said second end thereof in a direction generally towards said first pivot axis.

7. The handle assembly of claim 6 wherein each of said first and second handle means are pivotally interconnected with said head by means of a pin.

8. The handle assembly of claim 6 wherein at least one of said first and second handle means further comprises:

an elongated lever member pivotally interconnected with said head; and handle grip means fixedly interconnected with said elongated lever member.

9. The handle assembly of claim 6 wherein at least one of said first and second biasing means comprises a spring.

10. The handle assembly of claim 6 wherein at least one of said first and second biasing means comprises a jack.

* * * * *